US006050776A

United States Patent [19]

Akagi et al.

[11] Patent Number: 6,050,776

[45] Date of Patent: Apr. 18, 2000

[54] GAS TURBINE STATIONARY BLADE UNIT

[75] Inventors: Koichi Akagi; Yukihiro Hashimoto; Masahito Kataoka; Yasuoki Tomita; Hiroji Tada, all of Takasago, Japan

[73] Assignee: Mitsubishi Heavy Industries, Ltd., Tokyo, Japan

[21] Appl. No.: 09/152,797

[22] Filed: Sep. 14, 1998

[30] Foreign Application Priority Data

Sep. 17, 1997 [JP] Japan ..... 9-252098
Oct. 22, 1997 [JP] Japan ..... 9-289821

[51] Int. Cl.[7] ..... F01D 9/00

[52] U.S. Cl. ..... 415/209.4; 415/138; 415/139; 415/208.2; 415/210.1

[58] Field of Search ..... 415/209.4, 138, 415/139, 208.2, 210.1

[56] References Cited

U.S. PATENT DOCUMENTS

| | | | |
|---|---|---|---|
| 4,015,910 | 4/1977 | Harmon et al. | 415/217 |
| 4,492,517 | 1/1985 | Klompas | 415/139 |
| 4,720,236 | 1/1988 | Stevens | 415/136 |
| 5,167,485 | 12/1992 | Starkweather | 415/115 |

*Primary Examiner*—Edward K. Look
*Assistant Examiner*—Ninh Nguyen
*Attorney, Agent, or Firm*—Wenderoth, Lind & Ponack, L.L.P.

[57] ABSTRACT

A gas turbine stationary blade unit in which two stationary blades are formed in a single segment by divided shrouds functions to lessen the occurrence of cracks. Two stationary blades 1*a,* 1*b* are fixed to an outer shroud and an inner shroud, respectively. Each shroud is divided into two sections 2*a,* 2*b* and 3*a,* 3*b*. Flanges 4*a,* 4*b* are provided to connect the section together by bolts via boltholes 7. Likewise, flanges 5*a,* 5*b* are provided to form a similar connection or joint. If the two stationary blades 1*a,* 1*b* are fixed in a single segment by the shrouds which are not divided, a restraining force becomes larger, local stress occurs due to thermal stress and the frequency of crack occurrence increases. However, since the shrouds are divided respectively into two parts and jointed together by bolts, the crack occurrence is lessened. Also, pinholes are provided in opposing faces at the divided portion of the shrouds. Also, pins are inserted into the pinholes for connection of the divided shrouds, thereby relative movement between the divided shrouds is prevented and a strong jointed blade unit is provided.

4 Claims, 7 Drawing Sheets

Fig. 10 (a) (Prior Art)
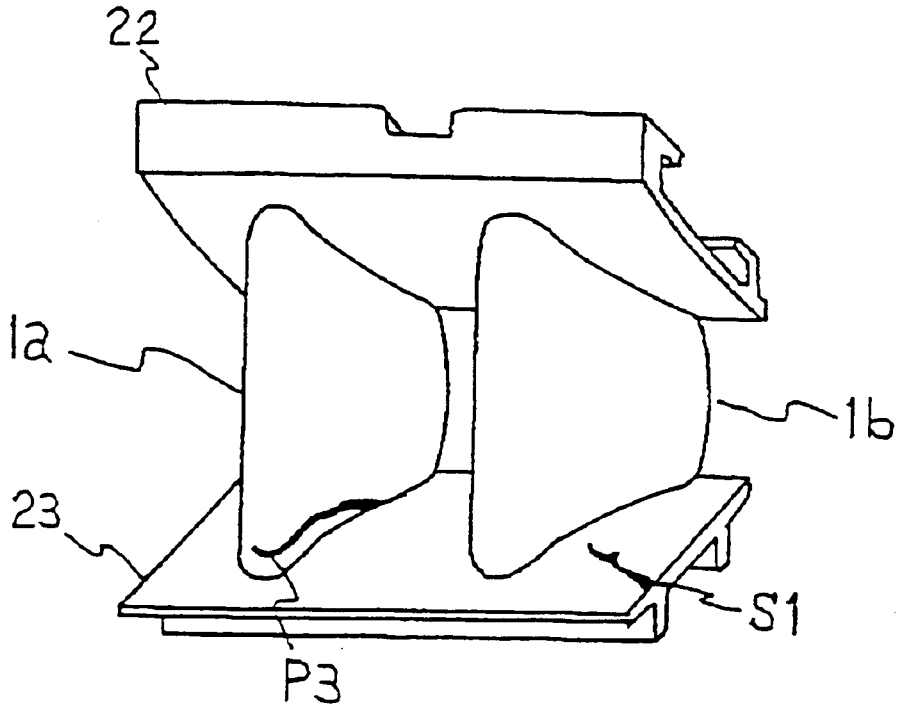
Fig. 10 (b) (Prior Art)
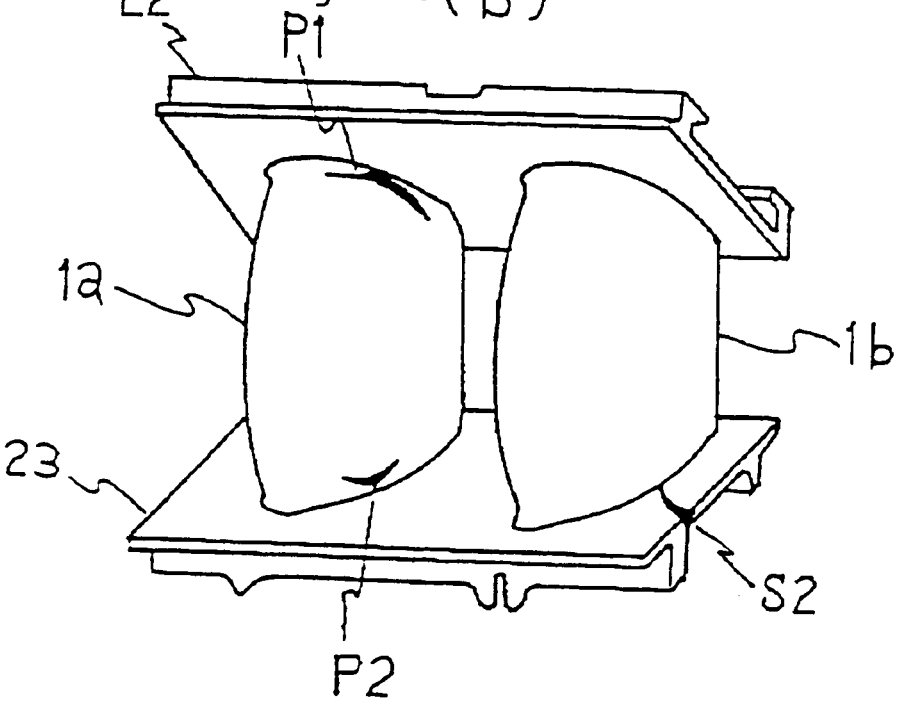

GAS TURBINE STATIONARY BLADE UNIT

BACKGROUND OF THE INVENTION

1. Field of the Invention

The present invention relates to a segmented gas turbine stationary blade unit in which two stationary blades are assembled in one shroud unit so as to reduce the influence of thermal stress on the blades or shroud and to avoid occurrence of cracks.

2. Description of the Prior Art

In gas turbine stationary blades, air leaks from an inner side through a gap between mutually adjacent inner shrouds is discharged into combustion gas passage, which results in an increased power burden on the compressor. Recently, in order to lessen the gap which causes the leakage, trials are being performed in order to make the stationary blades in a segmented form. In this case, plural stationary blades are fixed in one unit by shrouds, hence there occurs a large restraining force between the blades and this causes local stress concentrations due to thermal stress, and thus cracks occur frequently.

FIGS. 10(*a*) and (*b*) are perspective views of a prior are segmented stationary blade unit showing a state of occurrence of cracks.

In the figures, numeral 1*a,* 1*b* designate stationary blades, respectively. Numeral 22 designates an outer shroud and numeral 23 designates an inner shroud. The two stationary blades 1*a,* 1*b* are fixed in a shroud unit comprising the outer shroud 22 and the inner shroud 23 so as to form a segment.

When the stationary blades 1*a*, 1*b* are constructed as a single unit, the stationary blades 1*a*, 1*b* and the outer and inner shrouds 22, 23 are mutually restrained so that unreasonable or large forces occur due to thermal stress, and thus cracks are liable to occur in an inner side portion P3 of the stationary blade 1*a* and in a portion S1 of the inner shroud 23, as shown in FIG. 10(*a*). Cracks are also likely to develop in both end portions P1, P2 of the stationary blade 1*a* and in a portion S2 of the inner shroud 23, as shown in FIG. 10(*b*).

In the gas turbine stationary blades, as mentioned above, in order to reduce leakage of the seal air, trials are being performed a to make the stationary blades segmented so as to lessen the gap between mutually adjacent inner shrouds. On the other hand, when the stationary blades are segmented, the restraining force becomes a larger, thus stress local concentrations occur due to thermal stress, and thus cracks occur frequently.

SUMMARY OF THE INVENTION

It is therefore an object of the present invention to provide a segmented gas turbine stationary blade unit comprising two stationary blades. The blade unit includes an outer shroud and an inner shroud which are arranged so as to mitigate a restraining force between the stationary blades in order to prevent stress concentration from occurring due to thermal stress.

In order to attain the above object, the present invention provides means of following:

(1) A gas turbine stationary blade unit built in a segment such that two stationary blades, arranged around a turbine rotor, are fixed at their respective end portions to an outer shroud and an inner shroud. The outer shroud and inner shroud are divided into two sections, respectively, between the two stationary blades. Also, flanges are provided on the end portions respectively of the outer shroud sections and inner shroud sections for being jointed together by bolts.

(2) A gas turbine stationary blade unit built in a segment such that two stationary blades, arranged around a turbine rotor, are fixed at their respective end portions to an outer shroud and an inner shroud. The inner shroud is divided into two sections between the two stationary blades. Also, flanges are provided on the divided end portions of the inner shroud for being jointed together by bolts.

(3) A gas turbine stationary blade unit, as mentioned in items (1) or (2) above, further including pinholes, extending in a turbine rotation tangential direction, are provided in respective faces of divided portion of the divided shrouds. Pins are inserted into the pinholes to connect the divided shrouds. The pins have a thermal expansion coefficient that is larger than that of the shrouds.

With respect to item (1) above, two stationary blades are built in a segment and both the outer shroud and the inner shroud are divided. Thereby, strain caused by the thermal stress is divided and dispersed so that the restraining force due to the thermal stress is reduced, and the occurrence of local stress in the end portions of the blade or in the inner shroud can be avoided so that the frequency of crack occurrence due to the local stress is lessened and the blade life is elongated. Also, in the divided outer and inner shrouds, the flanges of the divided shrouds are connected together by bolts so that the two stationary blades are fixed integratedly in a single segment or unit by the outer and inner shrouds. Thereby the same function of the prior art segmented blade unit is maintained, and moreover the gap between the inner shrouds is lessened and leakage of the seal air can be reduced.

With respect to item (2) above, only the inner shroud is divided and equal effects to the construction described in item (1) above can be obtained especially in the case where a lot of cracks occur in the inner shroud surface or in the inner side end portions of the stationary blade. In this case, the same effect as with the construction described in item (1) above is not expected for cracks occurring in the outer side end portions of the blade, but as the outer shroud is not divided, there is an advantage in that the assembling process is facilitated.

With respect to item (3) above, the inner and outer shrouds are divided, and the divided and mutually adjacent shroud sections are connected by the pins. Each of the pins has a larger thermal expansion coefficient than the shrouds, and is inserted in on of the pinholes provided in the faces at the divided portion. The shroud sections are connected by bolts via the flanges formed by the fitting plates provided along the faces at the divided portion. Thus, the jointed gas turbine stationary blade unit is constructed, hence, by virtue of the divided shrouds of the jointed blade unit. The rigidity of the shrouds is lowered and the temperature distribution is softened so that the thermal stress at the blade end portions is mitigated. Further, by virtue of the jointed structure, relative movement between the mutually adjacent shrouds is prevented so that an integrated behavior therebetween is formed and a strong jointed blade unit is obtained.

BRIEF DESCRIPTION OF THE DRAWINGS

FIGS. 10(*a*) and (*b*) are perspective views of prior art gas turbine stationary blade units showing the simultaneous of occurrence of cracks.

DETAILED DESCRIPTION OF THE INVENTION

Figure 1:
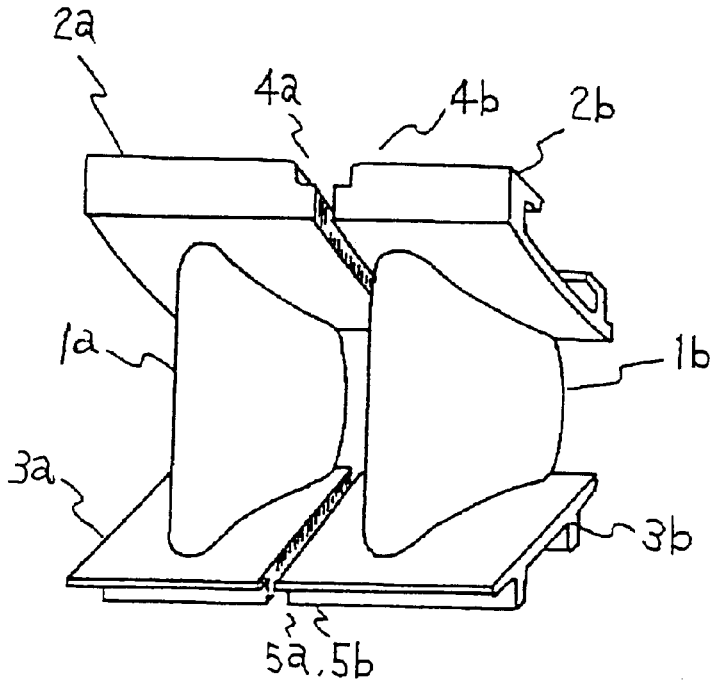
FIG. 1 is a perspective view of a gas turbine stationary blade unit of a first embodiment according to the present invention.

Herebelow, embodiments of the present invention will be described with reference to the drawing figures. FIG. 1 is a perspective view of a gas turbine stationary blade unit constructed in accordance with a first embodiment of the present invention and, as illustrated, an outer shroud and an inner shroud are constructed so as to be divided at a central portion thereof and jointed together by bolts.

In FIG. 1, reference numerals 1*a*, 1*b* designate stationary blades and numerals 2*a*, 2*b* designate a divided outer shroud sections, which fix together the stationary blades l*a*, 1*b*. Reference numerals 3*a*, 3*b* designates a likewise divided inner shroud sections, which fix together the stationary blades 1*a*, 1*b*. The divided portion is a mid portion between the two stationary blades 1*a*, 1*b*, as shown in FIG. 1, and flanges 4*a*, 4*b* (not shown) are provided at the divided portion of the outer shroud sections 2*a*, 2*b*. The flanges are jointed together by bolts. Likewise, at the divided portion of the inner shroud sections 3*a*, 3*b*, flanges 5*a*, 5*b* (not shown) are provided and are jointed together by bolts.

Figure 2:
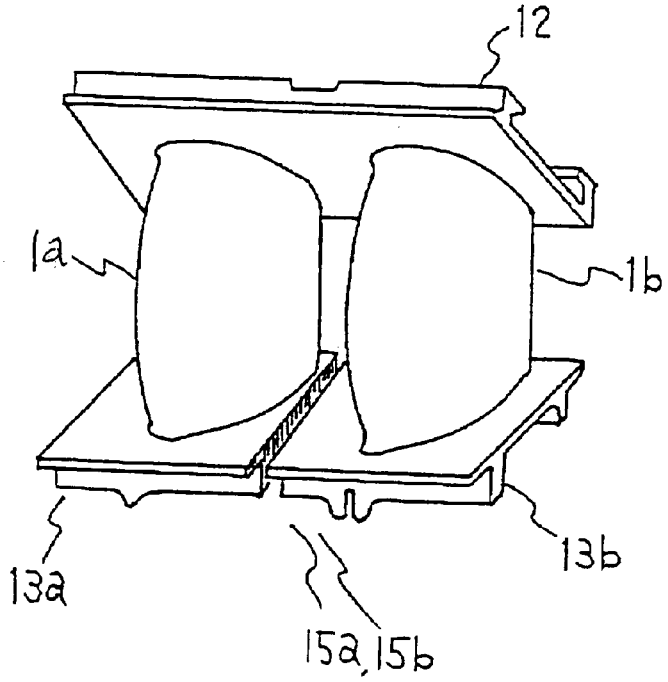
FIG. 2 is a perspective view of a gas turbine stationary blade unit of a second embodiment according to the present invention.

FIG. 2 is a perspective view of a gas turbine stationary blade unit constructed in accordance with a second embodiment of the present invention. In the first embodiment, both the outer shroud and the inner shroud are divided, while only the inner shroud is divided in the second embodiment.

In FIG. 2, reference numerals 1*a*, 1*b* designate a stationary blades and reference numeral 12 designates an outer shroud, which is not divided and, thus fixes the stationary blades 1*a*, 1*b* together. Reference numerals 13*a*, 13*b* designate a divided inner shroud and, like in FIG. 1, flanges 15*a*, 15*b* are provided and are jointed together by bolts.

Figure 3:
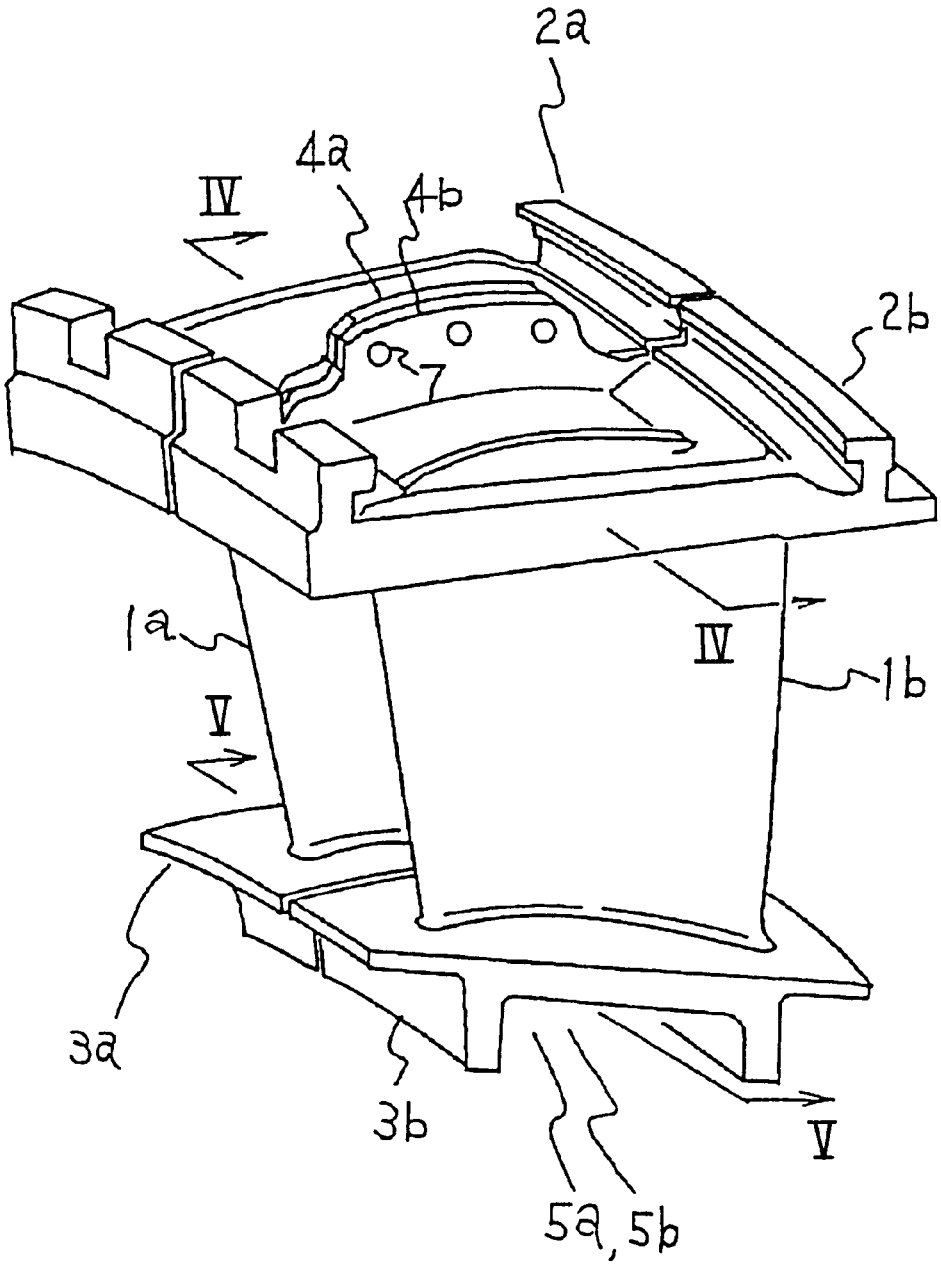
FIG. 3 is a perspective view of the gas turbine stationary blade unit of the first embodiment of FIG. 1 and shows a bolt joint at a divided portion of an outer shroud.

FIG. 3 is a perspective view of the gas turbine stationary blade unit of the first embodiment of FIG. 1, and FIG. 3 shows the bolt joint at the divided portion of the outer shroud.

In FIG. 3, flanges 4*a*, 4*b* are provided at divided end portions of the divided outer shroud sections 2*a*, 2*b*. Boltholes 7 are bored through the flanges 4*a*, 4*b* so that they can be jointed together by bolts. That is, the divided portions are jointed together again by bolts.

With respect to the divided inner shroud sections 3*a*, 3*b*, although not shown, flanges 5*a*, 5*b* are also provided at the divided portion, similar to the divided outer shroud sections 2*a*, 2*b*, and jointed together by bolts. By employing such a construction, while providing the same function of the prior art segmented blade the restraining force due to the thermal stress is mitigated and local stress concentrations are prevented from occurring.

Figure 4:
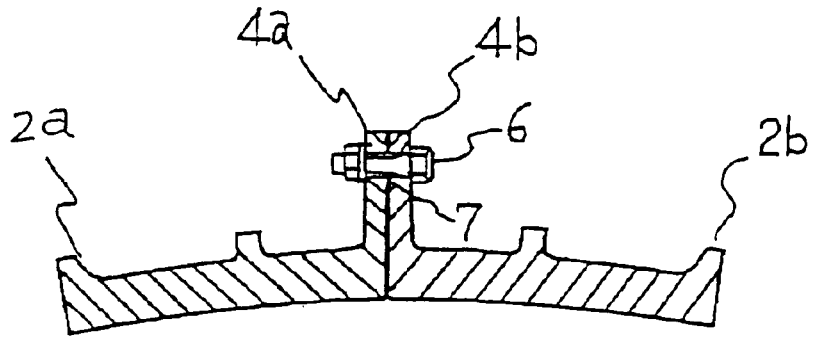
FIG. 4 is a cross sectional view taken along line IV—IV of FIG. 3.

FIG. 4 is a cross sectional view taken along line IV—IV of FIG. 3. In FIG. 4, flanges 4*a*, 4*b* are provided on the divided outer shroud sections 2*a*, 2*b* and boltholes 7 are bored through both of the flanges 4*a*, 4*b* so that the flanges 4*a*, 4*b* can be jointed together by bolts and nuts 6.

Figure 5:
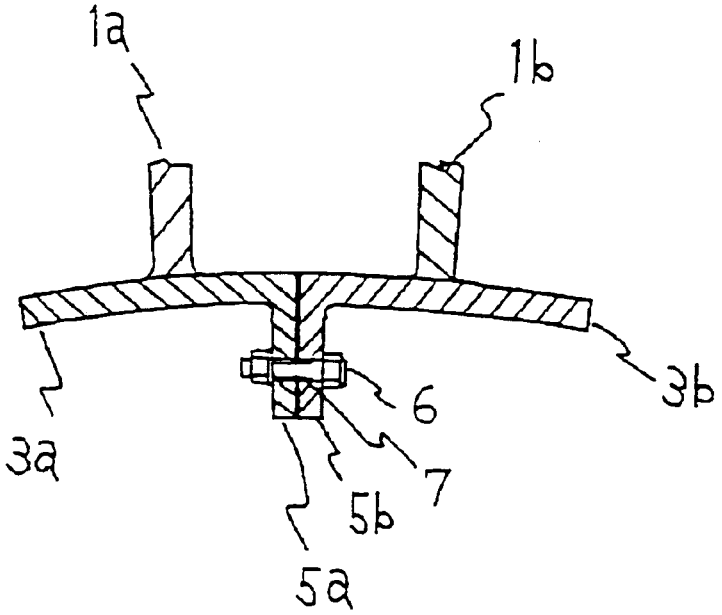
FIG. 5 is a cross sectional view taken along line V—V of FIG. 3.

FIG. 5 is a cross sectional view taken along line V—V of FIG. 3. In FIG. 5, flanges 5*a*, 5*b* are provided on the divided inner shroud sections 3a, 3b so as to project therefrom toward an inner side thereof (toward a rotor side), and like in the divided outer shroud sections 2*a*, 2*b*, boltholes 7 are bored and the flanges 5*a*, 5*b* are jointed together by bolts and nuts 6. Needless to mention, with respect to the divided inner shroud sections 13*a*, 13*b* of the second embodiment shown in FIG. 2, the same flange construction is employed thereon.

Figure 6:
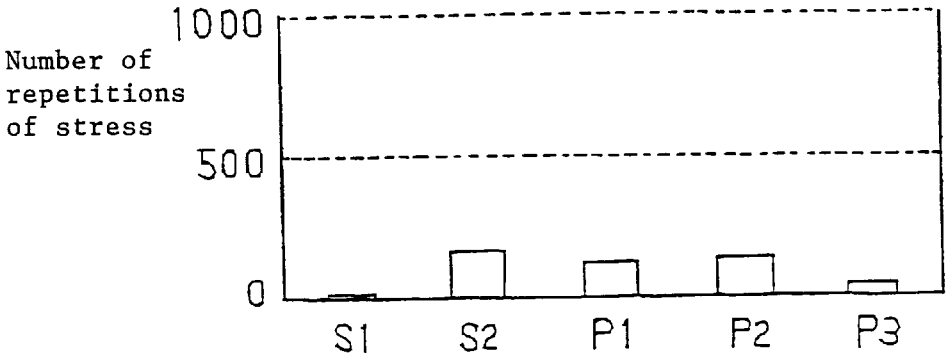
FIGS. 6(*a*)–6(*c*)are graphs showing life assessment of crack occurring portions in gas turbine second state stationary blade units in the prior art and the first and second embodiments, wherein FIG. 6(*a*) shows the assessment of the prior art, FIG. 6(*b*) shows the assessment of the second embodiment and FIG. 6(*c*) shows the assessment of the first embodiment.
Figure 6:
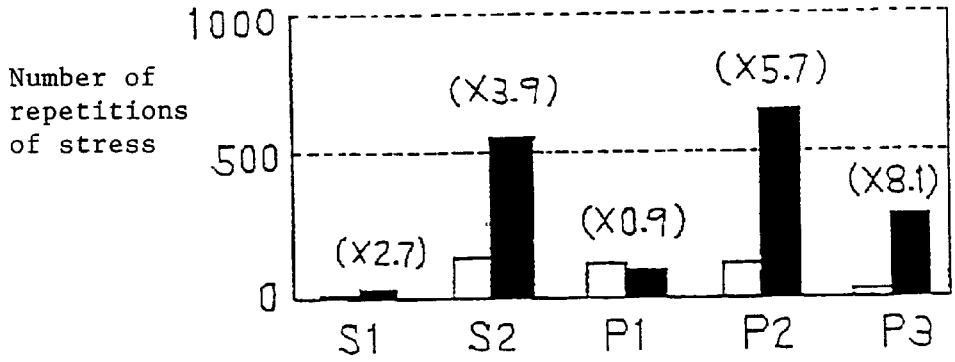
Figure 6:
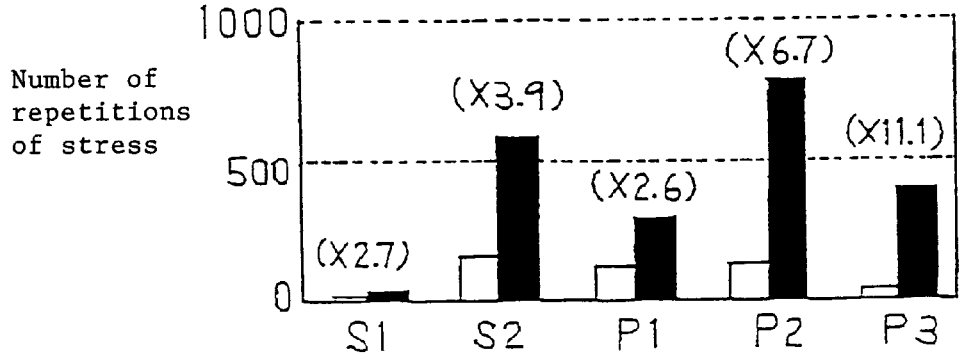

FIGS. 6(*a*)–6(*c*) are graphical representations of the life assessment of crack occurring portions in the prior art gas turbine second stage stationary blade units and in the first and second embodiments as described above. In particular, FIG. 6(*a*) shows the case of the prior art arrangement shown in FIG. 10 where the shroud is not divided. FIG. 6(*b*) shows the case of the second embodiment shown in FIG. 2 where only the inner shroud is divided, and FIG. 6(*c*) shows the case of the first embodiment shown in FIG. 1 where both the outer and inner shrouds are divided. In the figures, bar graphs show the crack occurring portions S1, S2, P1, P2 and P3 shown in FIGS. 10(*a*) and (*b*) on the horizontal axis and the number of repetitions of stress is indicated on the vertical axis. In FIGS. 6(*b*) and (*c*), the number of repetitions of stress of the second embodiment and the first embodiment, respectively, are shown in black bars and, in comparison thereof, the number of repetitions of the stress of the prior art device is shown in white bars with respect to each of the crack occurring portions, and magnifications of the black bars to the respective white bars are shown in parenthesis.

According to the life assessment of FIG. 6, in the case of FIG. 6(*b*) where only the inner shroud is divided, life endurance at S2 and P2 becomes 3.9 times and 5.7 times, respectively, that of the prior art arrangement. Also, at P3 it becomes 8.1 times, hence it is found that the life up of the blade unit until the crack occurrence has increased remarkably. Also, in the case of FIG. 6(*c*) where both the outer and inner shrouds are divided, likewise the life endurance becomes 3.9 times at S2, 6.7 times at P2 and 11.1 times at P3. Clearly, the life of the blade unit up until the crack occurrence, has increased more than in the case where only the one shroud is divided.

According to the first and second embodiments as described above, the stationary blade unit is constructed such that both the outer shroud and the inner shroud are divided or only the inner shroud is divided. Also, flanges 4*a*, 4b and 5*a*, 5*b* or 15*a*, 15*b* are provided on the divided portions and are jointed together by bolts and nuts 6. Thereby the same function as that of the segmented structure consisting of two stationary blades is maintained, and moreover, the frequency of crack occurrence due to the local stress concentration can be lessened greatly.

Figure 7:
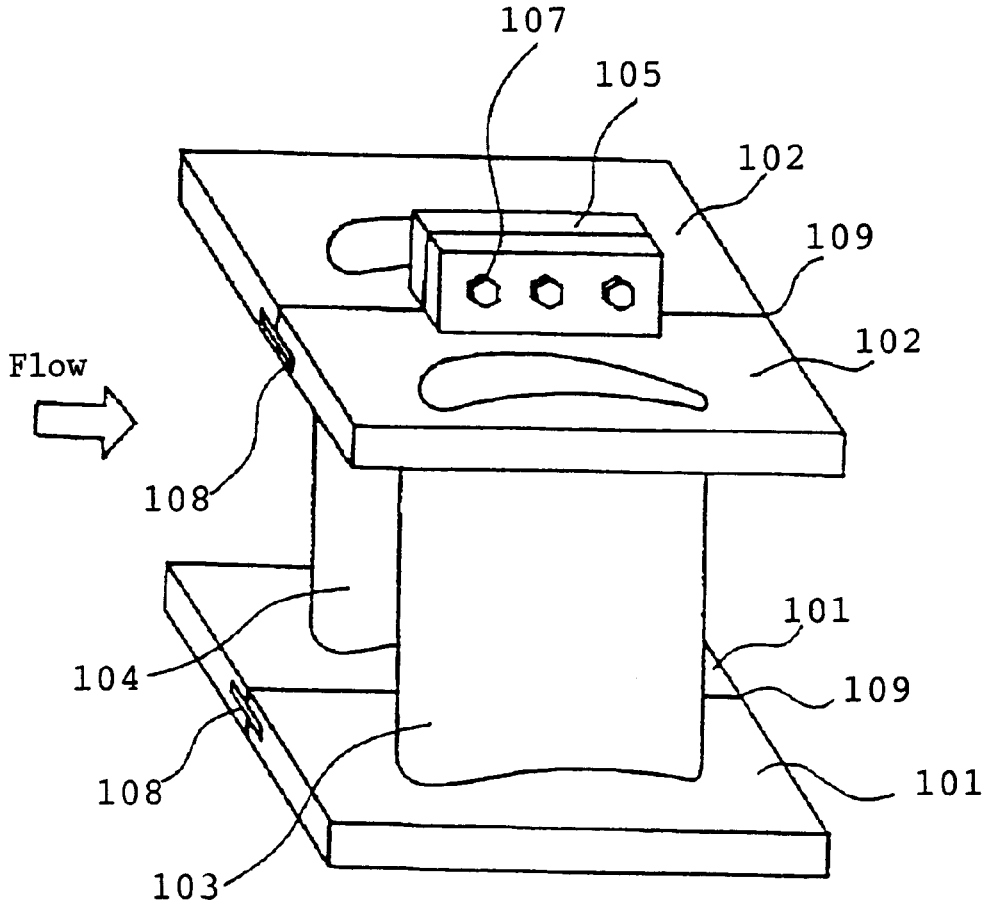
FIG. 7 is a perspective view of an assembly unit of gas turbine stationary blades of a third embodiment according to the present invention.
Figure 8:
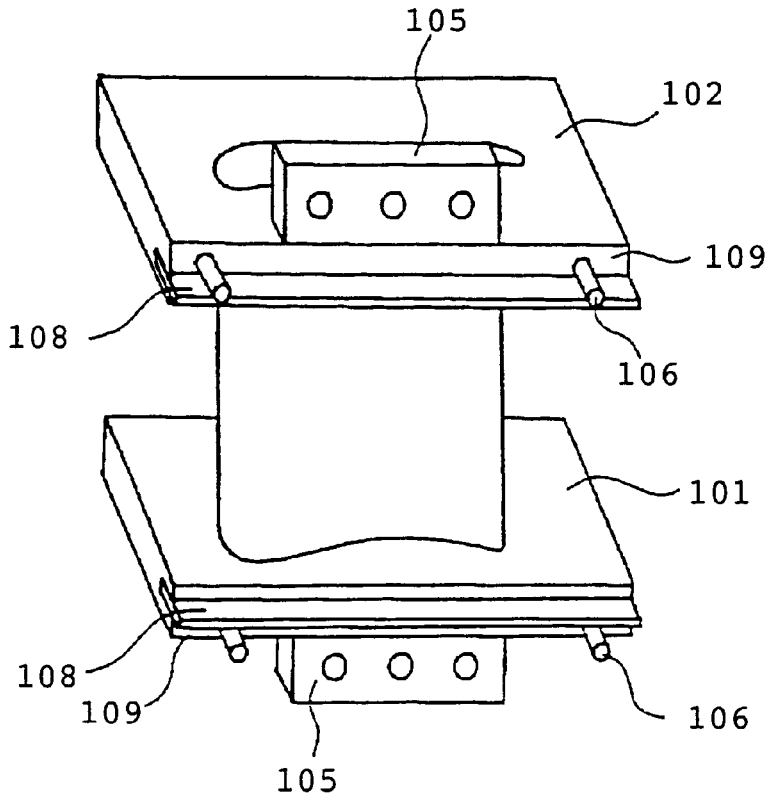
FIG. 8 is an explanatory view showing one divided portion of the assembly unit of FIG. 7.
Figure 9:
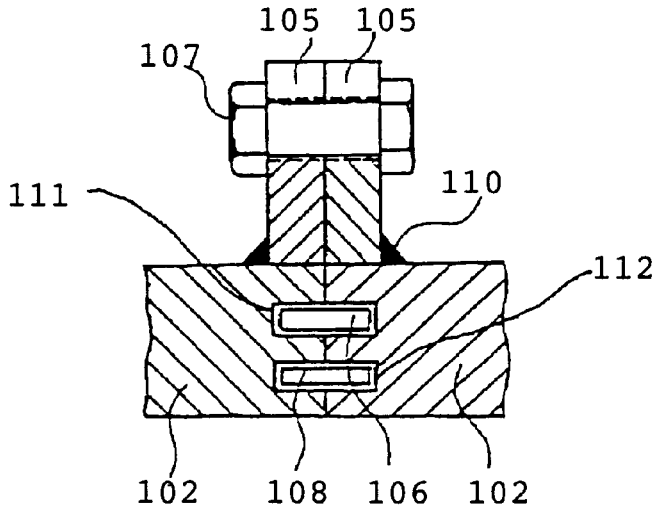
FIG. 9 is an explanatory view showing details of support pins, fitting plates, etc. in a flange portion of the assembly unit of FIG. 7.

Next, a third embodiment according to the present invention will be described with reference to FIGS. 7 to 9. FIG. 7 is a perspective view of gas turbine stationary blade assembly unit of the third embodiment. FIG. 8 is an explanatory view showing one divided portion of the assembly unit of FIG. 7 which is divided into two parts, and FIG. 9 is an explanatory view showing details of support pins, fitting plates, etc. in a flange portion of the assembly unit of FIG. 7.

In the present embodiment, like in the first embodiment, an inner shroud 101 and an outer shroud 102 are divided into two parts, respectively, at a divided portion 109 which extends substantially in an axial direction of the turbine. The assembly unit is divided into two shroud portions, that is, a portion connected to a stationary blade 103 and a portion connected to a stationary blade 104 which is adjacent to the stationary blade 103.

In the opposing faces at the divided portion 109 and at positions near both lengthwise ends thereof, pinholes 111 are bored extending in a tangential direction of the turbine rotation, so that both pinholes 111 bored in the respective faces at the divided portion 109 of the two shroud portions are connected to each other. Support pins 106 are inserted into the pinholes 111 to thereby connect the divided two shroud sections.

It is to be noted that the support pins 106 are made of hastelloy material of which the thermal expansion coefficient corresponds to 16 to $20\times10^{-6}$/°C. and the inner shroud 101 and the outer shroud 102 are made of a nickel base heat resistant alloy of which the thermal expansion coefficient corresponds to 12 to $16\times10^{31\ 6}$/°C.

In the opposing faces at the divided portion 109 of the inner shroud 101 and the outer shroud 102 and on a side of operating gas flow of the pinholes 111, that is, on an outer side in a turbine radial direction of the pinholes 111 with respect to the inner shroud 101 and on an inner side in the turbine radial direction of the pinholes 111 with respect to the outer shroud 102, there are provided seal grooves 112 which connect to each other in the opposing faces of the mutually adjacent shroud portions at the divided portion 109, and seal plates 108 are fitted in the seal grooves 112, thus enhancing the seal at the faces of divided portion 109.

Further, at positions near lengthwise central portion of the respective faces at divided portion 109 of the inner shroud 101 and the outer shroud 102 and on an inner side in the turbine radial direction of the pinholes 111 with respect to the inner shroud 101 and on an outer side in the turbine radial direction of the pinholes 111 with respect to the outer shroud 102, reversely of the case of the seal grooves 112, fitting plates are fixed by welding 110 to form flanges 105 and the respective flanges 105 of the mutually adjacent shroud portions are jointed together by bolts 107.

That is, in the present embodiment, the inner shroud 101 is divided into the inner shroud 101 portion of the blade 103 and the inner shroud 101 portion of the blade 104. And, the outer shroud 102 is divided into the outer shroud 102 portion of the blade 103 and the outer shroud 102 portion of the blade 104. The inner shroud portions as well as the outer shroud 102 portions are jointed by fitting the support pins 106 in the pinholes 111 in the faces of divided portion 109. Further, the flanges 105, fixed by welding on the inner and outer sides of the respective faces of divided portion 109, are connected together by bolts 107. Thus, a jointed blade unit consisting of the blade 103 and the blade 104 is constructed.

At blade end portions at which the blades 103, 104 are connected to the inner and outer shrouds 101, 102, respectively, thermal stress acts on the blades 103, 104 themselves, and moreover there is a large influence due to thermal deformation of the inner and outer shrouds 101, 102. And, thus influence of the inner and outer shrouds 101, 102 is governed by the rigidity of, and the temperature distribution in, the inner and outer shrouds 101, 102.

In the present embodiment, however, the inner shroud 101 and the outer shroud 102 are divided, as mentioned above, hence the rigidity of the shrouds is lower, the temperature distribution becomes softened, deformation of the shrouds such as warp or the like becomes smaller and forces acting on the blades become smaller, thereby alleviation of the thermal stress can be attained.

Also, between the respective f aces of divided portion 109, there are provided the seal plates 108, which ensure the sealing between these faces. Further, in the respective faces of divided portion 109 of the inner shroud 101 and the outer shroud 102, the support pins 106, which have a larger thermal expansion coefficient than the shrouds, are inserted in the pinholes 111. Hence, due to the difference in the thermal elongation between the material of the support pins 106 and the material of the shrouds in which the pinholes 111 are bored, a surface pressure acts between the support pins 106 and the pinholes 111, which prevents relative displacement between the support pins 106 and the shrouds so that an integrated behavior therebetween is formed. Thus, the burden of the bolts 107 which joint the flanges 105 is mitigated remarkably and the soundness of this jointed blade unit is greatly enhanced.

The present invention has been described with respect to the embodiments as illustrated herein but the present invention is not limited thereto but may be added with various modifications in the above-described structure within the scope of the claims as set forth herebelow. For example, although in the third embodiment, both the inner shroud and the outer shroud are divided, only the inner shroud may be divided into two parts, similar to the second embodiment.

What is claimed is:

1. A gas turbine blade unit comprising:

a first stationary blade having an inner end portion and an outer end portion;

a second stationary blade disposed adjacent to said first stationary blade, and having an inner end portion and an outer end portion;

an outer shroud divided into a first outer shroud section and a second outer shroud section, wherein said outer end portions of said first and second stationary blades are connected to said first and second outer shroud sections, respectively;

flanges provided on said first and second outer shroud sections, respectively, so that said first and second outer shroud sections can be secured together by bolts;

an inner shroud divided into a first inner shroud section and a second inner shroud section, wherein said inner end portions of said first and second stationary blades are connected to said first and second inner shroud sections, respectively;

flanges provided on said first and second inner shroud sections, respectively, such that said first and second outer shroud sections can be secured together by bolts;

pinholes provided in opposing faces of said first and second outer shroud sections and extending in a turbine rotation tangential direction, said opposing faces extending in a turbine axial direction; and pins inserted into said pinholes, respectively, wherein said pins have a thermal expansion coefficient which is larger than that of said inner and outer shrouds.

2. A gas turbine blade unit as claimed in claim 1, further comprising:

opposing grooves formed in said opposing faces of said first and second outer shroud sections, respectively;

a sealing plate having opposite edge portions inserted in said opposing grooves, respectively.

3. A gas turbine blade unit comprising:

a first stationary blade having an inner end portion and an outer end portion;

a second stationary blade disposed adjacent to said first stationary blade, and having an inner end portion and an outer end portion;

an inner shroud connected to said inner end portions of said first and second stationary blades;

an outer shroud connected to outer end portions of said first and second stationary blades, wherein said outer shroud is continuous and only said inner shroud is divided between said first and second stationary blades; and flanges provided on said divided portions of said inner shroud for connecting together said divided portions of inner shroud via bolts.

4. A gas turbine stationary blade unit as claimed in claim 3, further comprising:

pinholes provided in opposing faces of said inner shroud portions which extend in a turbine axial direction, wherein said pinholes extend in a turbine rotation tangential direction; and pins inserted into said pinholes, respectively, wherein said pins have a thermal expansion coefficient which is larger than that of said inner shroud.

* * * * *